US011490721B2

(12) United States Patent
Chu

(10) Patent No.: US 11,490,721 B2
(45) Date of Patent: Nov. 8, 2022

(54) BRISTLE CARRIER OF HAIRBRUSH

(71) Applicant: Peng-Fei Chu, Taipei (TW)

(72) Inventor: Peng-Fei Chu, Taipei (TW)

( * ) Notice: Subject to any disclaimer, the term of this patent is extended or adjusted under 35 U.S.C. 154(b) by 530 days.

(21) Appl. No.: 16/706,589

(22) Filed: Dec. 6, 2019

(65) Prior Publication Data

US 2021/0169210 A1 Jun. 10, 2021

(51) Int. Cl.

| | |
|---|---|
| ***A46B 9/06*** | (2006.01) |
| ***A46B 9/02*** | (2006.01) |
| ***A46B 3/00*** | (2006.01) |

(52) U.S. Cl.

CPC ..... *A46B 9/06* (2013.01); *A46B 3/005* (2013.01); *A46B 9/023* (2013.01); *A46B 2200/104* (2013.01)

(58) Field of Classification Search

CPC ..... A46B 9/06; A46B 3/005; A46B 9/023; A46B 2200/104

See application file for complete search history.

(56) References Cited

U.S. PATENT DOCUMENTS 4,139,312 A * 2/1979 Marano ..... A46B 3/005 401/176

6,773,076 B1 8/2004 Weihrauch

FOREIGN PATENT DOCUMENTS

| | | |
|---|---|---|
| DE | 10 2014 221314 A1 | 4/2015 |
| DE | 20 2016 005653 U1 | 10/2016 |
| WO | 2013/113014 A1 | 8/2013 |

* cited by examiner

*Primary Examiner* — Andrew A Horton

(74) *Attorney, Agent, or Firm* — Demian K. Jackson; Jackson IPG PLLC

(57) ABSTRACT

A hairbrush includes a bristle carrier including a surface and a plurality of first and second bristles fastened on the surface. The first bristles and the second bristles are arranged in rows and have a plurality of different configurations. In one embodiment, a bent member is formed on a top of each second bristle.

26 Claims, 9 Drawing Sheets

BRISTLE CARRIER OF HAIRBRUSH

BACKGROUND OF THE INVENTION

1. Field of the Invention

The invention relates to hairbrushes and more particularly to a bristle carrier of a hairbrush having improved characteristics.

2. Description of Related Art

Hairbrush is a stick brush with rigid or soft spokes used in hair care for smoothing, styling, and detangling human hair. Hairbrushes have many types and bristles thereof can have different shapes and/or sizes.

However, conventional hairbrushes are disadvantageous because they cannot solve the problem of intertwined hair strands.

Thus, there is a need of providing a novel hairbrush capable of detangling, smoothing, styling, combing, and curling hair strands in an effective way.

SUMMARY OF THE INVENTION

It is therefore one object of the invention to provide a hairbrush comprising a bristle carrier including a surface and a plurality of first and second bristles fastened on the surface wherein the first bristles and the second bristles are arranged to have a plurality of different configurations.

According to an embodiment of the present invention, the hairbrush further comprises a plurality of bristle turfs fastened on the surface, wherein the first bristles and the second bristles are arranged on the surface, and wherein each first bristle is disposed in the bristle turf.

According to an embodiment of the present invention, the hairbrush further comprises a plurality of bristle turfs fastened on the surface, wherein the bristle turfs are disposed externally of the first bristles and the second bristles on the surface.

The invention has the following advantages and benefits in comparison with the conventional art: a hairbrush incorporating the bristle carrier is effective in hair care for smoothing, styling, and detangling human or animal hair.

The above and other objects, features and advantages of the invention will become apparent from the following detailed description taken with the accompanying drawings.

DETAILED DESCRIPTION OF THE INVENTION

Figure 1:
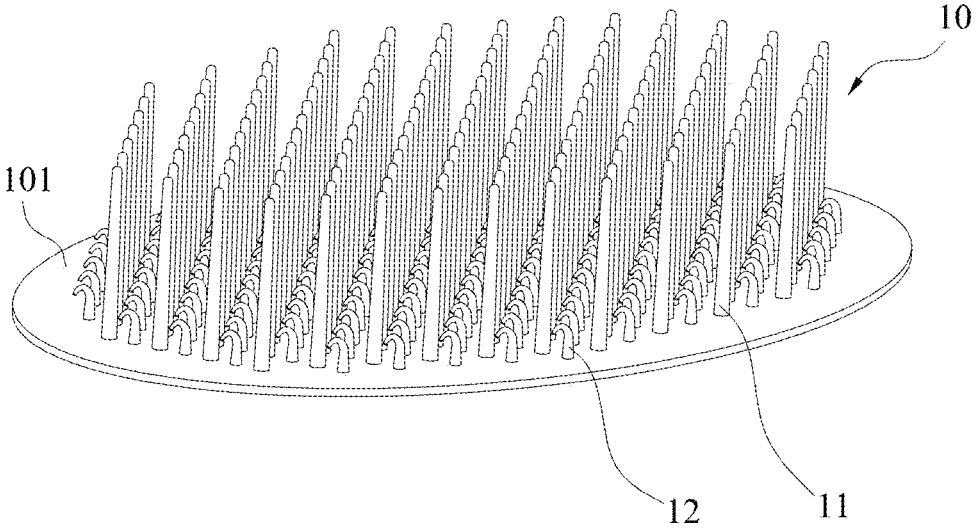
FIG. 1 is a perspective view of a bristle carrier of a hairbrush according to a first preferred embodiment of the invention.

Referring to FIGS. 1 to 5, a bristle carrier 10 of a hairbrush in accordance with a first preferred embodiment of the invention comprises a surface 101 and a plurality of first and second bristles 11, 12 fastened thereon. The first bristles 11 and the second bristles 12 are arranged in rows and have different configurations. For example, a top end of the first bristle 11 is shaped as a half-sphere. Alternatively, the top end of the first bristle 11 is shaped a sphere (see FIG. 3).

Figure 2:
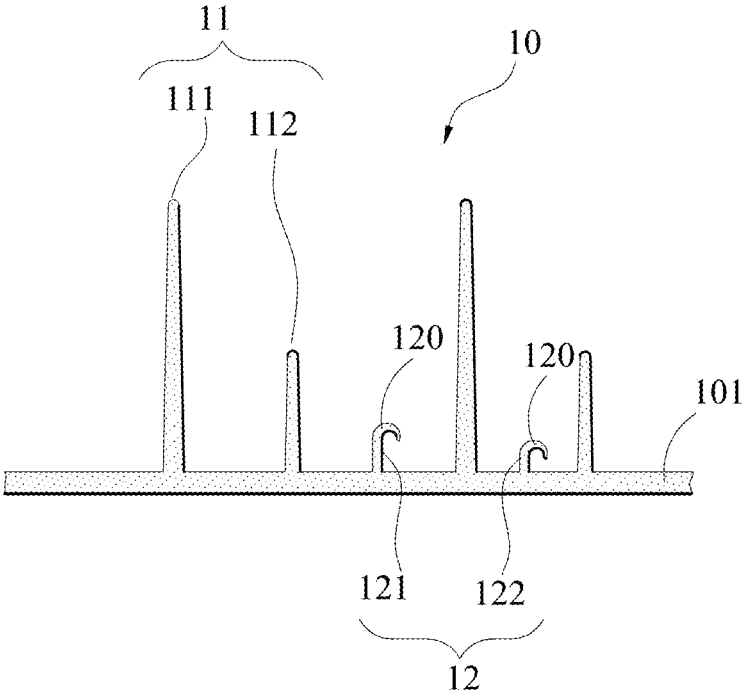
FIG. 2 is a longitudinal sectional view of a portion of the bristle carrier.

As shown in FIG. 2, the first bristles 11 extend upward from the surface 101. Height of the first bristle 11 can be increased to form a first long bristle 111 or shortened to form a first short bristle 112. That is, a distance from a top of the first long bristle 111 to the surface 101 is different from that from a top of the first short bristle 112 to the surface 101. Alternatively, heights of the first bristles 11 are the same. That is, distances from tops of the first bristles 11 to the surface 101 are the same.

Figure 2A:
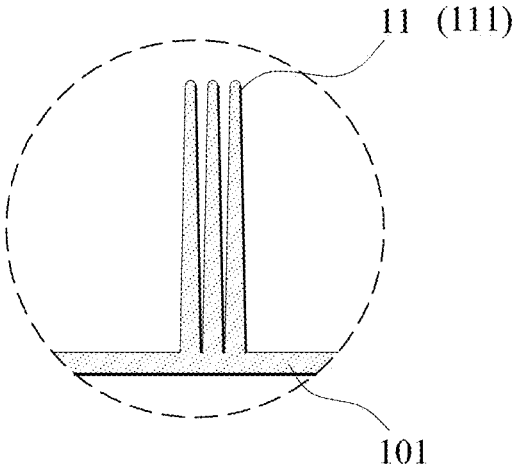
FIG. 2A is a transverse sectional view of a portion of the bristle carrier showing a first configuration of the first bristles.
Figure 2B:
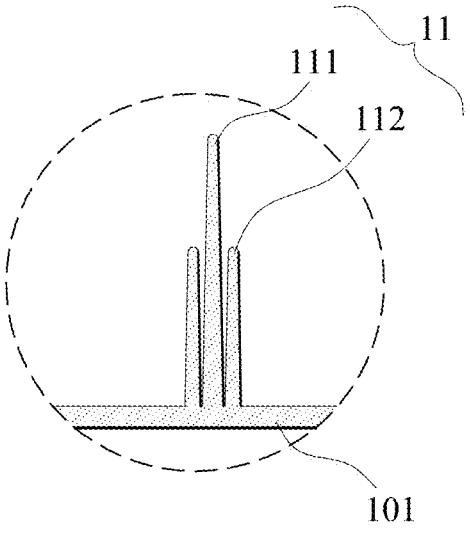
FIG. 2B is a longitudinal sectional view of the portion of the bristle carrier showing a second configuration of the first bristles.

The first bristles 11 are arranged on the surface 101 in tight rows in which three first long bristles 111 are arranged as a cluster (see FIG. 2A). Alternatively, the first bristles 11 are arranged in a plurality of clusters consisting of a first long bristle 111 and two first short bristles 112 (see FIG. 2B).

The first bristles 11 and the surface 101 are formed integrally in a mold by injection molding. Thus, the first bristles 11 are secured to the surface 101. Alternatively, the first bristles 11 and the surface 101 are formed in two different molds by injection mold prior to implanting the first bristles 11 perpendicular to the surface 101.

Similarly, the second bristles 12 extend upward from the surface 101. In comparison with the first bristle 11, the second bristle 12 further comprises a hook shaped bent member 120 on a top. Height of the second bristle 12 can be increased to form a second long bristle 121 or shortened to form a second short bristle 122. That is, a distance from the bent member 120 of the second long bristle 121 to the surface 101 is different from that from the top end 120 of the second short bristle 122 to the surface 101. Alternatively, heights of the second bristles 12 are the same. That is, distances from the bent members 120 of the second bristles 12 to the surface 101 are the same.

Figure 3:
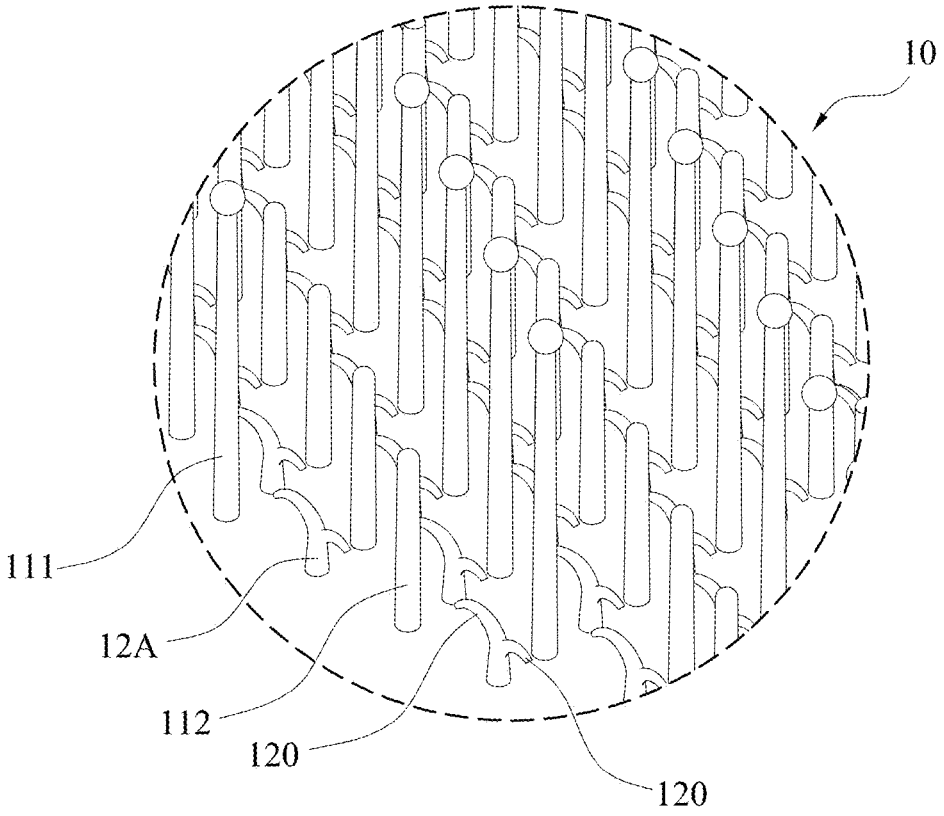
FIG. 3 is an enlarged view of a portion of the bristle carrier shown in FIG. 1.
Figure 3A:
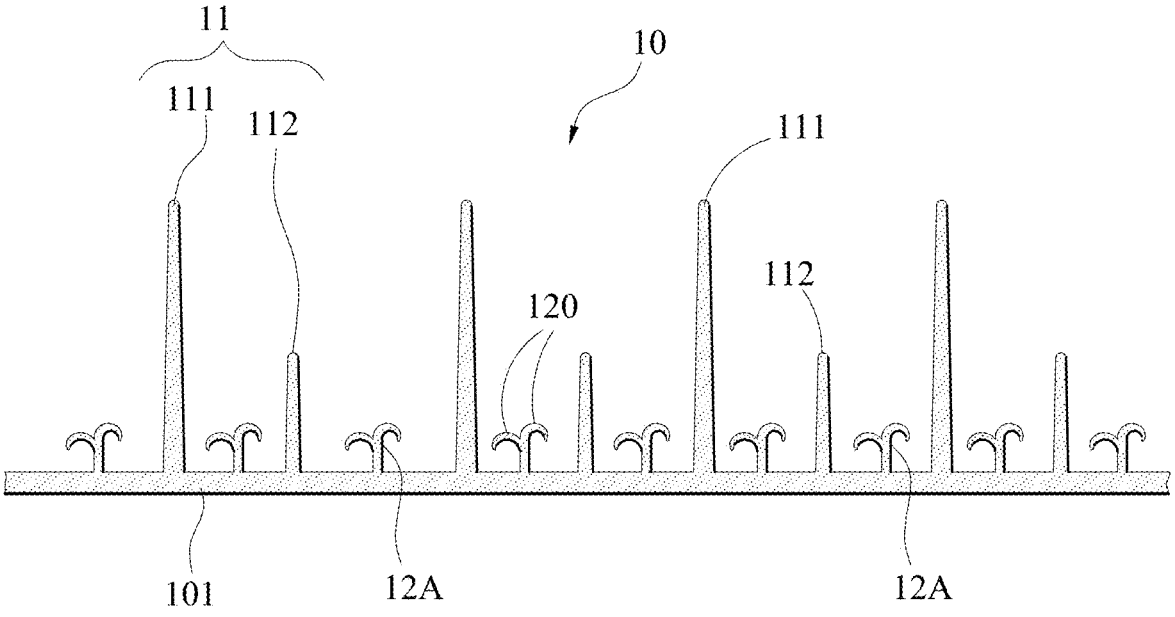
FIG. 3A is a side elevation, sectional view of FIG. 3.
Figure 4:
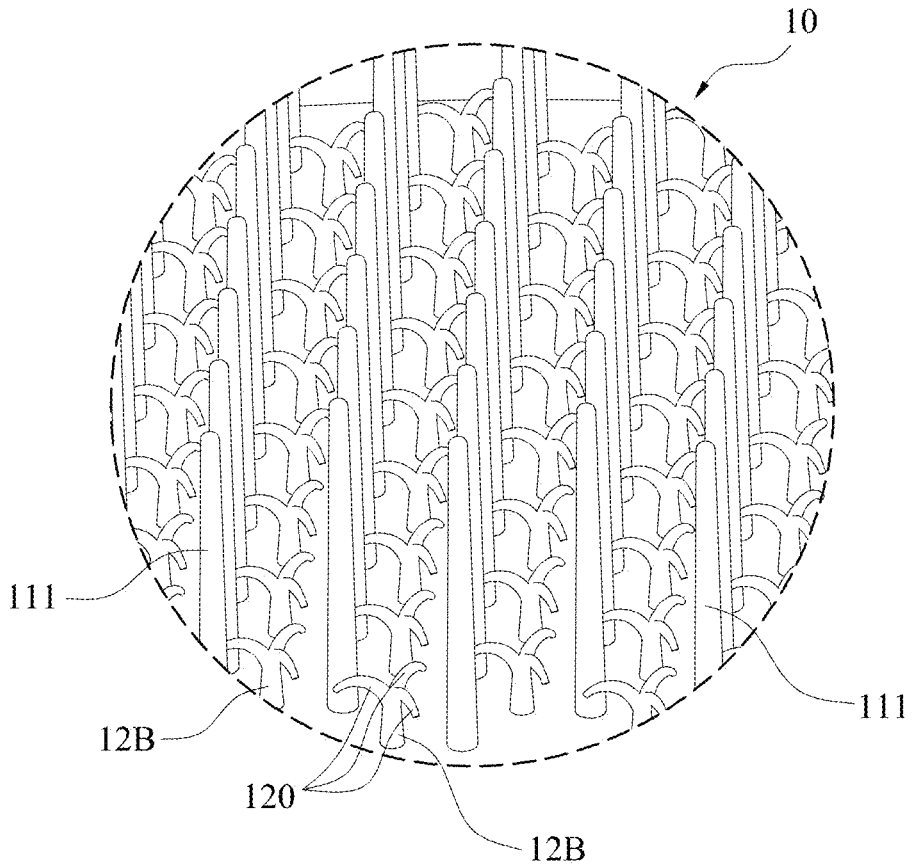
FIG. 4 is an enlarged perspective view of a portion of the bristle carrier shown in FIG. 1 showing the second bristles.
Figure 5:
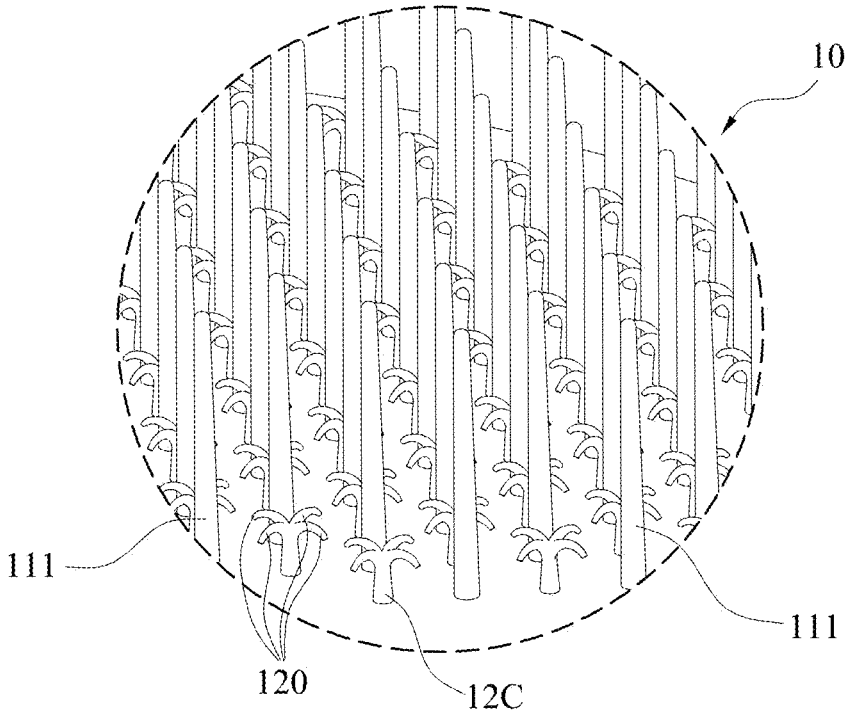
FIG. 5 is another enlarged perspective view of a portion of the bristle carrier shown in FIG. 1 showing the second bristles.

As shown in FIGS. 3 and 3A, each second bristle 12A has two bent members 120 which are oriented in two opposite directions. As shown in FIG. 4, each second bristle 12B has three bent members 120 equally spaced apart. As shown in FIG. 5, each second bristle 12C has four bent members 120 equally spaced apart.

Likewise, the second bristles 12 and the surface 101 are formed integrally in a mold by injection molding. Thus, the second bristles 12 are secured to the surface 101. Alternatively, the second bristles 12 and the surface 101 are formed in two different molds by injection mold prior to implanting the second bristles 12 in the surface 101.

Figure 6:
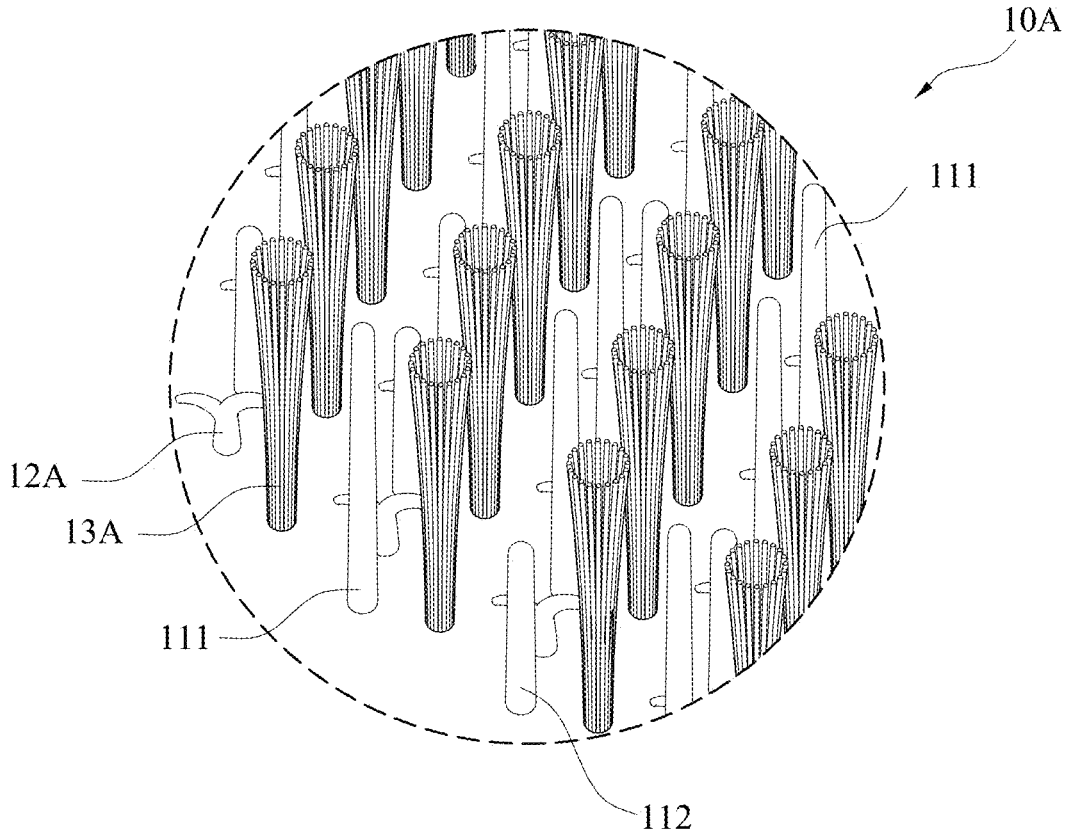
FIG. 6 is an enlarged perspective view of a portion of a bristle carrier of a hairbrush according to a second preferred embodiment of the invention.
Figure 6A:
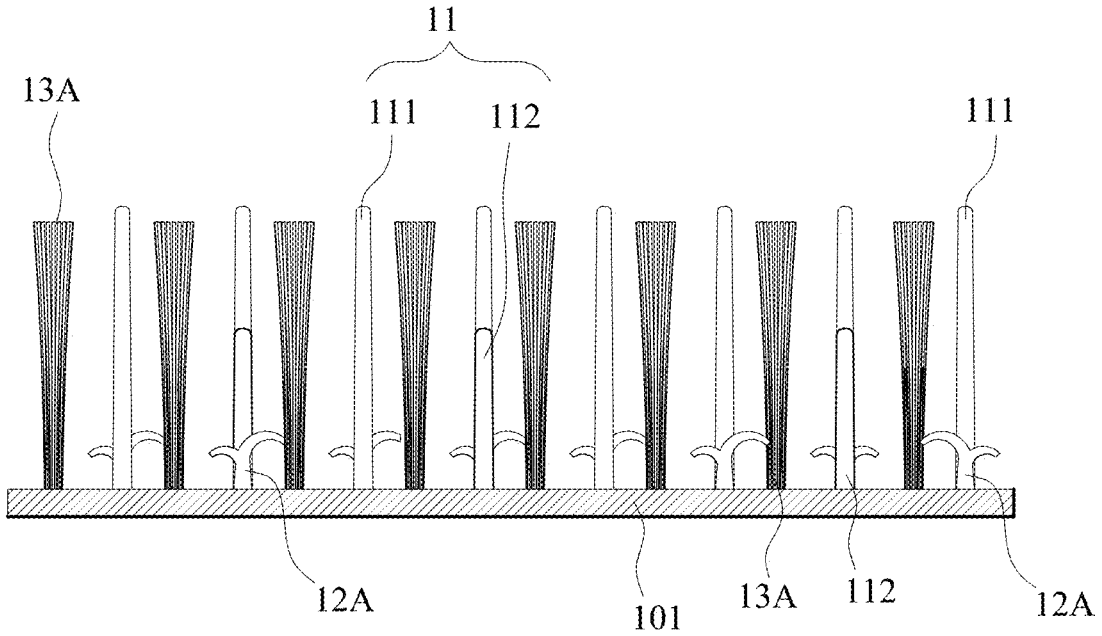
FIG. 6A is a longitudinal sectional view of a portion of the bristle carrier shown in FIG. 6.

Referring to FIGS. 6 and 6A, a bristle carrier 10A of a hairbrush in accordance with a second preferred embodiment of the invention comprises a surface 101. The bristle carrier 10A further comprises a plurality of first bristles 11 (including the first long bristles 111 and the first short bristles 112) fastened on the surface 101, a plurality of second bristles 12A fastened on the surface 101, and a plurality of bristle turfs 13A are disposed externally of the first bristles 11 and the second bristles 12 fastened on the surface 101.

Figure 7:
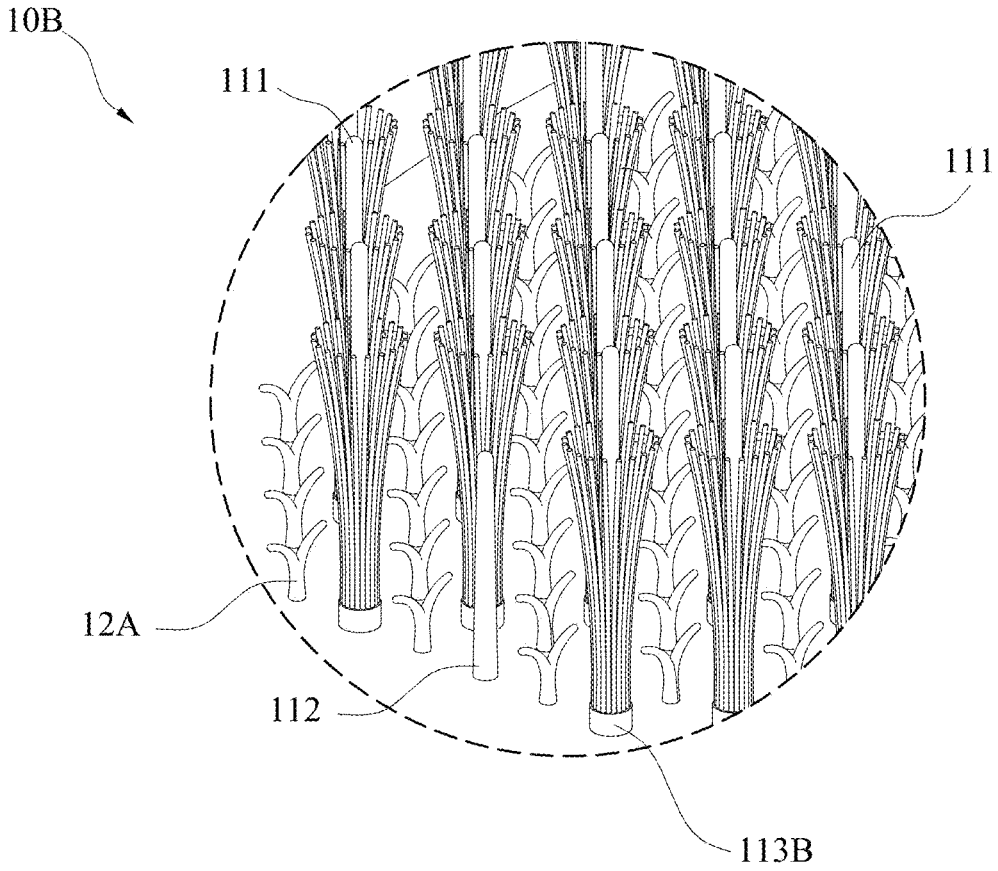
FIG. 7 is an enlarged perspective view of a portion of a bristle carrier of a hairbrush according to a third preferred embodiment of the invention.
Figure 7A:
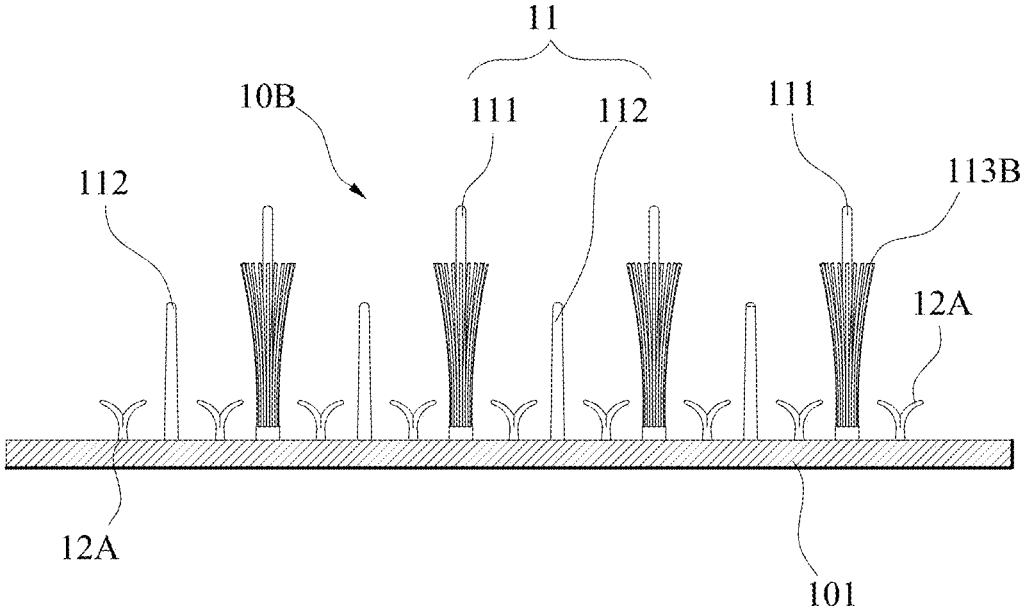
FIG. 7A is a longitudinal sectional view of a portion of the bristle carrier shown in FIG. 7.

Referring to FIGS. 7 and 7A, a bristle carrier 10B of a hairbrush in accordance with a third preferred embodiment of the invention comprises a surface 101. The bristle carrier 10B further comprises a plurality of first bristles 11 (including the first long bristles 111 and the first short bristles 112), a plurality of bristle turfs 113B surrounded the first long bristles 111, all the first long bristles 111, the bristle turfs 113B and the first short bristles 112 fastened on the surface 101, and a plurality of second bristles 12A fastened on the surface 101. As shown, each first long bristle 111 is disposed in the bristle turf 113B.

Figure 8:
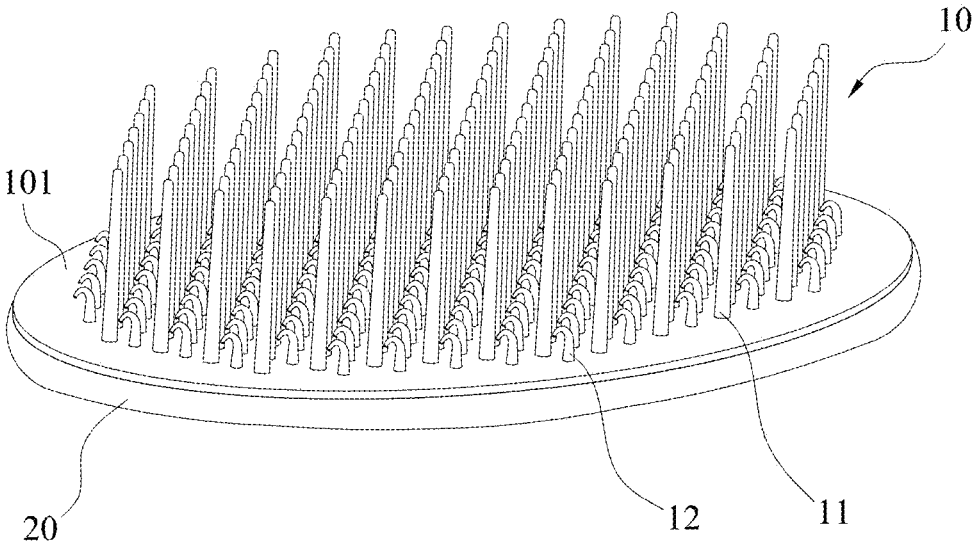
FIG. 8 is a perspective view of the bristle carrier according to any of the preferred embodiments with a base formed therebelow.

Referring to FIG. 8, a base 20 is further formed on a bottom of the surface 101 of any of the bristle carriers 10, 10A and 10B. A user may hold the base 20 and use the hairbrush to smooth, style, and detangle hair strands. Shapes of the base 20 is not limited to the shown one as long as the base 20 can be secured to the bristle carrier 10, 10A or 10B.

Figure 9:
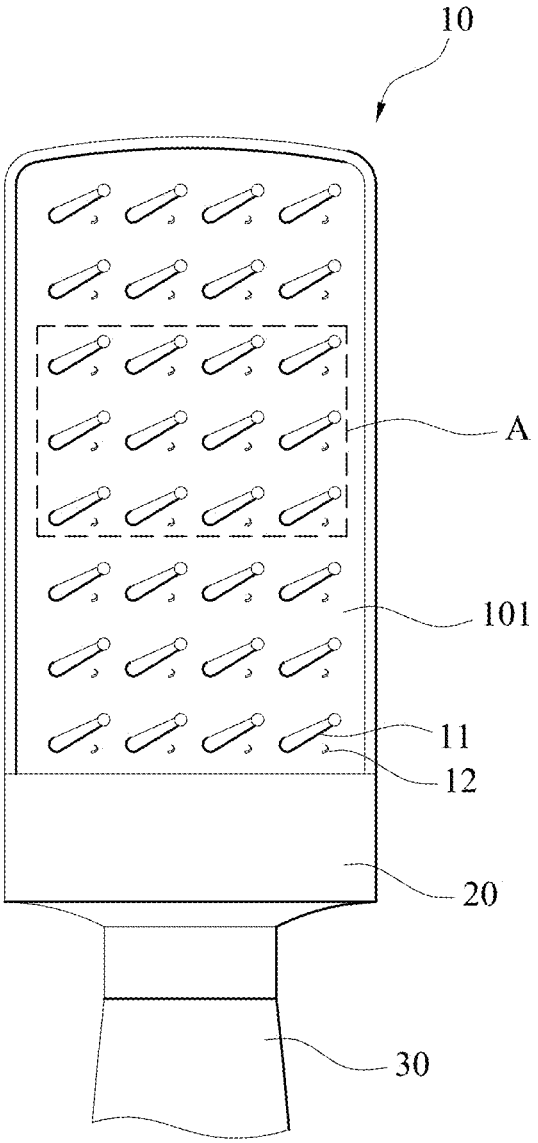
FIG. 9 is a perspective view showing a hairbrush incorporating the bristle carrier of the invention.
Figure 9A:
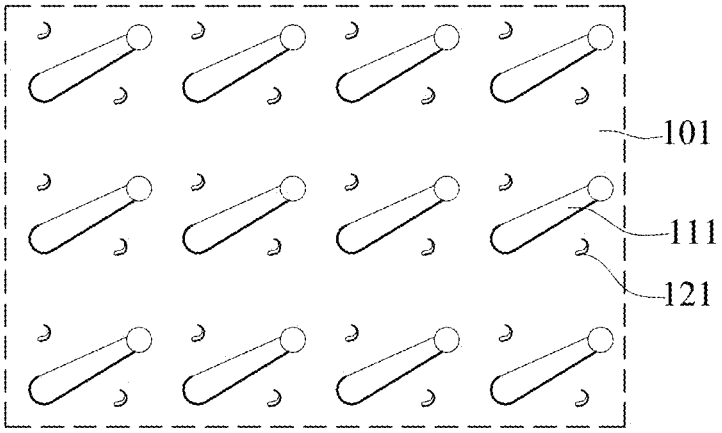
FIG. 9A is a detailed view of the area in a rectangle A of FIG. 9.

Referring to FIG. 9, a handle 30 is formed and extended from one end of the base 20. A user may hold the handle 30 and use the hairbrush to smooth, style, and detangle hair strands. Referring to FIG. 9A, the first long bristles 111 are equally spaced apart and the second long bristles 121 are also equally spaced apart.

Figure 9B:
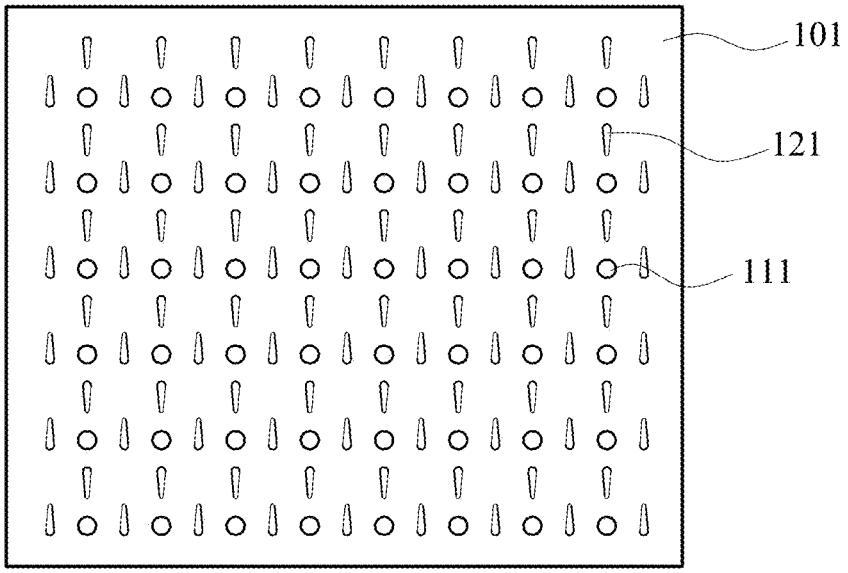
FIG. 9B is a top plan view of FIG. 9A.
Figure 9C:
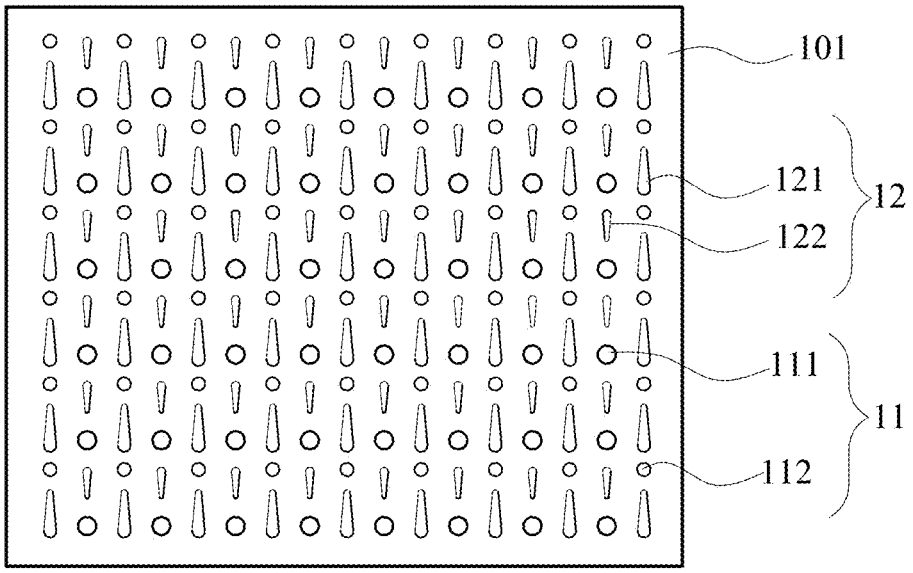
FIG. 9C is a top plan view showing another configuration of the bristles of FIG. 9.

Referring to FIG. 9B, it is a top plan view of FIG. 9A. As shown, the first long bristles 111 and the second long bristles 121 are formed on the surface 101. Referring to FIG. 9C, it is a top plan view and shows another configuration of the bristles of FIG. 9, The configuration includes the plurality of the first bristles 11 (including the first long bristles 111 and the first short bristles 112) and the plurality of the second bristles 12 (including the second long bristles 121 and the second short bristles 122) all formed on the surface 101.

The bristle carrier, the surface and the handle can be formed integrally by flexible materials suitable for injection molding for simplifying both the manufacturing process and the assembly.

The invention is applicable to hairbrushes for human or animal. For example, the hair brushes are circular hairbrushes, cylindrical hairbrushes, ventilation hairbrushes, buffer hairbrushes, peddle hairbrushes, palm hairbrushes, hair irons, hair straighteners, hair curlers, or any of other hairbrushes or electrical devices. A hairbrush incorporating the bristle carrier of the invention is effective in hair care for smoothing, styling, and detangling human or animal hair.

While the invention has been described in terms of preferred embodiments, those skilled in the art will recognize that the invention can be practiced with modifications within the spirit and scope of the appended claims.

What is claimed is:

1. A hairbrush, comprising a bristle carrier including a surface and a plurality of first and second bristles fastened on the surface wherein the first bristles and the second bristles are arranged to have a plurality of different configurations.

2. The hairbrush of claim 1, wherein the first bristles extend upward from the surface and are perpendicular to the bristle carrier.

3. The hairbrush of claim 2, wherein distance from tops of the first bristles to the surface are the same.

4. The hairbrush of claim 2, wherein distance from tops of the first bristles to the surface are different.

5. The hairbrush of claim 2, further comprising a plurality of bristle turfs fastened on the surface, wherein the first bristles and the second bristles are arranged on the surface, and wherein each first bristle is disposed in the bristle turf.

6. The hairbrush of claim 1, wherein the first bristles and the surface are formed integrally and the first bristles extend upward perpendicularly to the surface.

7. The hairbrush of claim 6, wherein distance from tops of the first bristles to the surface are the same.

8. The hairbrush of claim 6, wherein distance from tops of the first bristles to the surface are different.

9. The hairbrush of claim 6, further comprising a plurality of bristle turfs fastened on the surface, wherein the first bristles and the second bristles are arranged on the surface, and wherein each first bristle is disposed in the bristle turf.

10. The hairbrush of claim 1, wherein the second bristles extend upward from the surface and each second bristle includes a bent member on a top.

11. The hairbrush of claim 10, wherein the second bristles and the surface are formed integrally.

12. The hairbrush of claim 1, wherein the second bristles extend upward from the surface and each second bristle includes a plurality of bent members on a top.

13. The hairbrush of claim 12, wherein distances from the bent members to the surface are the same.

14. The hairbrush of claim 12, wherein distances from the bent members to the surface are different.

15. The hairbrush of claim 12, wherein the second bristles and the surface are formed integrally.

16. The hairbrush of claim 1, further comprising a plurality of bristle turfs fastened on the surface, wherein the bristle turfs are disposed externally of the first bristles and the second bristles on the surface.

17. The hairbrush of claim 16, wherein the first bristles and the surface are formed integrally and the first bristles extend upward perpendicularly to the surface.

18. The hairbrush of claim 17, wherein distance from tops of the first bristles to the surface are the same.

19. The hairbrush of claim 17, wherein distance from tops of the first bristles to the surface are different.

20. The hairbrush of claim 16, wherein the second bristles extend upward from the surface and each second bristle includes a bent member on a top.

21. The hairbrush of claim 20, wherein the second bristles and the surface are formed integrally.

22. The hairbrush of claim 16, wherein the second bristles extend upward from the surface and each second bristle includes a plurality of bent members on a top.

23. The hairbrush of claim 22, wherein the second bristles and the surface are formed integrally.

24. The hairbrush of claim 22, wherein distances from the bent members to the surface are the same.

25. The hairbrush of claim 22, wherein distances from the bent members to the surface are different.

26. The hairbrush of claim 1, wherein the bristle carrier is applicable to one of circular hairbrushes, cylindrical hairbrushes, ventilation hairbrushes, buffer hairbrushes, peddle hairbrushes, palm hairbrushes, hair irons, hair straighteners, and hair curlers.

* * * * *